US005570115A

United States Patent [19]

Kawai et al.

[11] Patent Number: 5,570,115

[45] Date of Patent: Oct. 29, 1996

[54] IMAGE PROCESSOR

[75] Inventors: Tomoaki Kawai; Hiroaki Sato, both of Kanagawa-ken, Japan

[73] Assignee: Canon Kabushiki Kaisha, Tokyo, Japan

[21] Appl. No.: 450,099

[22] Filed: May 25, 1995

Related U.S. Application Data

[63] Continuation of Ser. No. 267,312, Jun. 29, 1994, abandoned, which is a continuation of Ser. No. 77,496, Jun. 17, 1993, abandoned, which is a continuation of Ser. No. 589,260, Sep. 28, 1990, abandoned.

[30] Foreign Application Priority Data

Oct. 2, 1989 [JP] Japan ..... 1-258346

[51] Int. Cl.[6] ..... G09G 5/06

[52] U.S. Cl. ..... 345/199; 345/150; 345/115

[58] Field of Search ..... 345/199, 186, 345/187, 188, 201, 150, 115, 118, 119, 120, 185

[56] References Cited

U.S. PATENT DOCUMENTS

| | | | |
|---|---|---|---|
| 4,550,315 | 10/1985 | Bass et al. | 340/703 |
| 4,710,806 | 12/1987 | Iwai et al. | 340/703 |
| 4,727,425 | 2/1988 | Mayne et al. | 340/703 |
| 4,772,881 | 9/1988 | Hannah | 340/701 |
| 4,808,989 | 2/1989 | Tabata et al. | 340/703 |

*Primary Examiner*—Richard Hjerpe
*Assistant Examiner*—Xiao M. Wu
*Attorney, Agent, or Firm*—Fitzpatrick, Cella, Harper & Scinto

[57] ABSTRACT

An image processor having a display unit capable of displaying a plurality of color images. The display unit is provided with an administrating section for collectively managing color maps, thereby enabling a color map to be efficiently used in common for display of a plurality of images.

7 Claims, 6 Drawing Sheets

FIG. 6

22a

| PIXEL VALUE | RED | GREEN | BLUE |
|---|---|---|---|
| 0 | 0 | 0 | 255 |
| 1 | 0 | 3 | 252 |
| 2 | 0 | 6 | 249 |
| 3 | 0 | 9 | 246 |
| | | | |
| 254 | 252 | 3 | 0 |
| 255 | 255 | 0 | 0 |

IMAGE PROCESSOR

This application is a continuation of application Ser. No. 08/267,312 filed Jun. 29, 1994, now abandoned, which is a continuation of application Ser. No. 08/077,496 filed Jun. 17, 1993, now abandoned, which is a continuation of application Ser. No. 08/589,260 filed Sept. 28, 1990, now abandoned.

BACKGROUND OF THE INVENTION

1. Field of the Invention

This invention relates to an image processor capable of displaying a plurality of color images.

2. Description of the Prior Art

Recently, bit map type color displays having a multi-window system capable of handling a plurality of application software programs on the same display screen have popularly been used as display units of information processing systems such as work stations or personal computers.

The color of each dot (pixel) of such bit map color displays is controlled based on a color map consisting of a table such as that shown in FIG. 6, which has pixel values (fixed numbers) and values r (red), g (green), and b (blue) and in which the appropriate values r, g, and b are obtained if a corresponding pixel value is given. For example, an 8-bit-plane in bit map display has a color map having 256 ($=2^8$) entries and is capable of simultaneously displaying 256 colors at the maximum by using pixel values from 0 to 255, inclusive. These 256 colors are determined by arbitrary combinations of values r, g, and b. For example, if the values r, g, and b are each 8-bit, an arbitrary set of 256 colors can be selected from $2^8 \times 2^8 \times 2^8$ colors.

In a case where a certain application requires 64 colors for display, 64 entries are provided from 256 entries of the color map, and the values r, g, and b of each entry are set.

Conventionally, the provision of a color map and the setting of values r, g, and b and so on are effected separately and independently by the applications using the corresponding color map entries.

For this reason, in a case where a plurality of application programs run simultaneously to effect display through separate windows, each application independently prepares a color map, and the color map resources are soon exhausted. If in this state another application tries to run, (1) it cannot run because the desired color map cannot be provided, or (2) it is started by finding entries close to the values r, g, and b which are to be set among the color map entries already maintained and by setting the system so as to use such entries.

For image display, however, one color map is frequently used to form a plurality of images, and it is ordinarily necessary to suitably maintain the accuracy of values r, g, and b set in color maps.

In the case of a method in which (1) is true, the number of applications which can display images simultaneously is small. For example, an 8-bit-plane display unit can simultaneously display 256 colors. However, if several applications each requiring 64 display colors are running, it allows only 256/64=4 applications to be activated irrespective of whether or not some of the applications use a color map having the same values r, g, and b. That is, the number of applications which can run simultaneously is limited because no color map can be used in common for two applications.

In the case of a method in which (2) is true, if among color map entries already provided there are entries of the same values as the values r, g, and b which are to be set for the new application, and if such entries are found, the system can be set to use those entries and to effect display with the accurate values r, g, and b. However, if the number of color map entries to be set is large, it is necessary to search the previously-set color map entries one by one, and the time needed for this operation is long.

Also, in this case, it is possible that, depending upon the searching method, color maps will be assigned respectively to two applications requiring the same color map. This method also entails the problem of limitation of the number of applications which can run simultaneously, since the color maps are not effectively assigned.

The above-described problems are owing to failure to enable a plurality of applications to effectively hold color maps in common.

SUMMARY OF THE INVENTION

It is an object of the present invention to provide an image processor capable of starting many applications which use one screen simultaneously.

It is another object of the present invention to provide an image processor in which a plurality of applications which use one screen simultaneously can hold color maps in common effectively.

It is still another object of the present invention to provide an image processor capable of positively assigning the same color map to a plurality of applications which use one screen simultaneously.

According to one aspect, the present invention which achieves these objectives relates to an image processor capable of displaying color images, comprising: a display means capable of displaying a plurality of color images simultaneously; a plurality of display control means for controlling the plurality of color images; a color information memory means for storing, in a plurality of memory areas set with respect to the images, color information capable of being use for displaying the color images using the display means; and an administration means capable of assigning the memory areas of the color information memory means to the respective ones of said display control means so that the plurality of display control means can use one of the memory areas in common.

According to another aspect, the present invention which achieves these objectives relates to an image processor capable of displaying color images, comprising: a display means capable of displaying a plurality of color images simultaneously; a plurality of display control means for controlling the plurality of color images respectively; a color information memory means for storing, in a plurality of memory areas set with respect to the images, color information capable of being used for displaying the color images using the display means; a setting memory means for storing a plurality of types of setting information for the color information memory means; a selection means for selecting the setting to be utilized from the plurality of types of setting information; and an administration means capable of assigning the memory areas of the color information memory means to the display control means so that the plurality of display control means can use one of the memory areas in common.

Other objectives, features and advantages, besides those discussed above, will be apparent to those skilled in the art from the description of the preferred embodiment of the invention, which follows. In the description, reference is made to accompanying drawings, which form a part thereof, and which illustrate an example of the invention. Such example, however, is not exhaustive of the various embodiments of the invention, and therefore reference is made to the claims which follow the description for determining the scope of the invention.

BRIEF DESCRIPTION OF THE DRAWINGS

FIG. 6 is a diagram of an example of a color map.

DESCRIPTION OF THE PREFERRED EMBODIMENT

Figure 1:
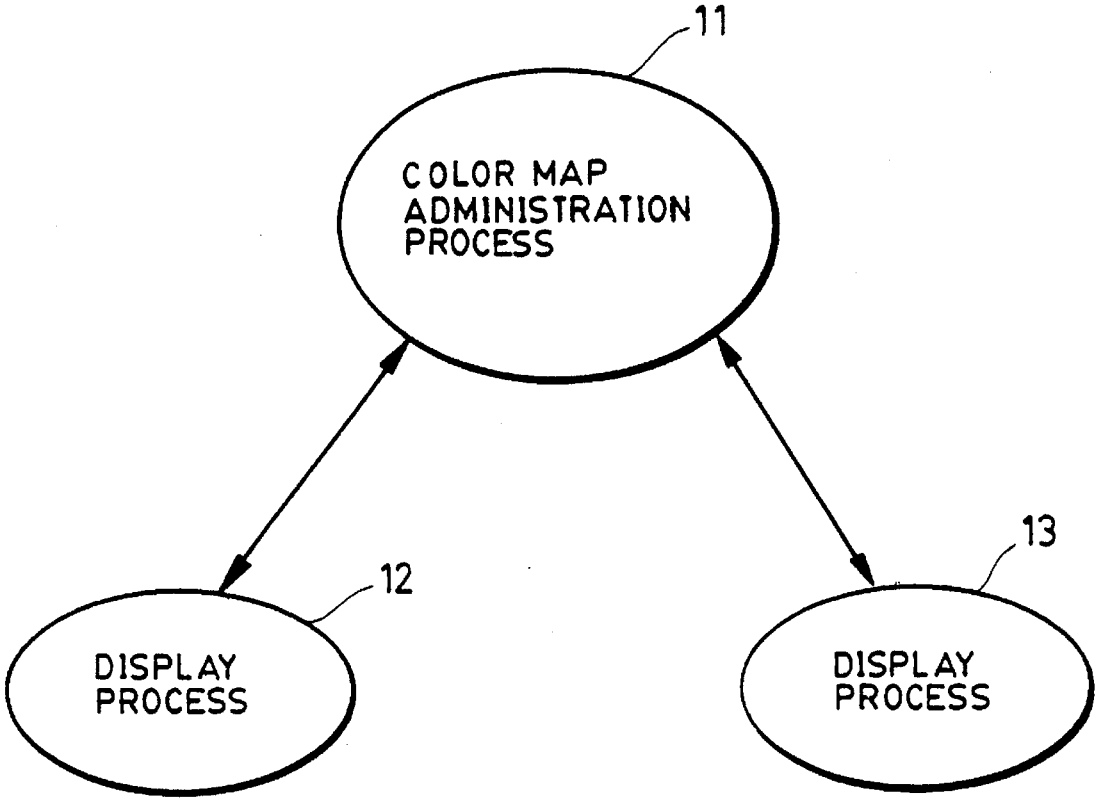
FIG. 1 is a diagram of the process construction of an embodiment of the present invention.
Figure 2:
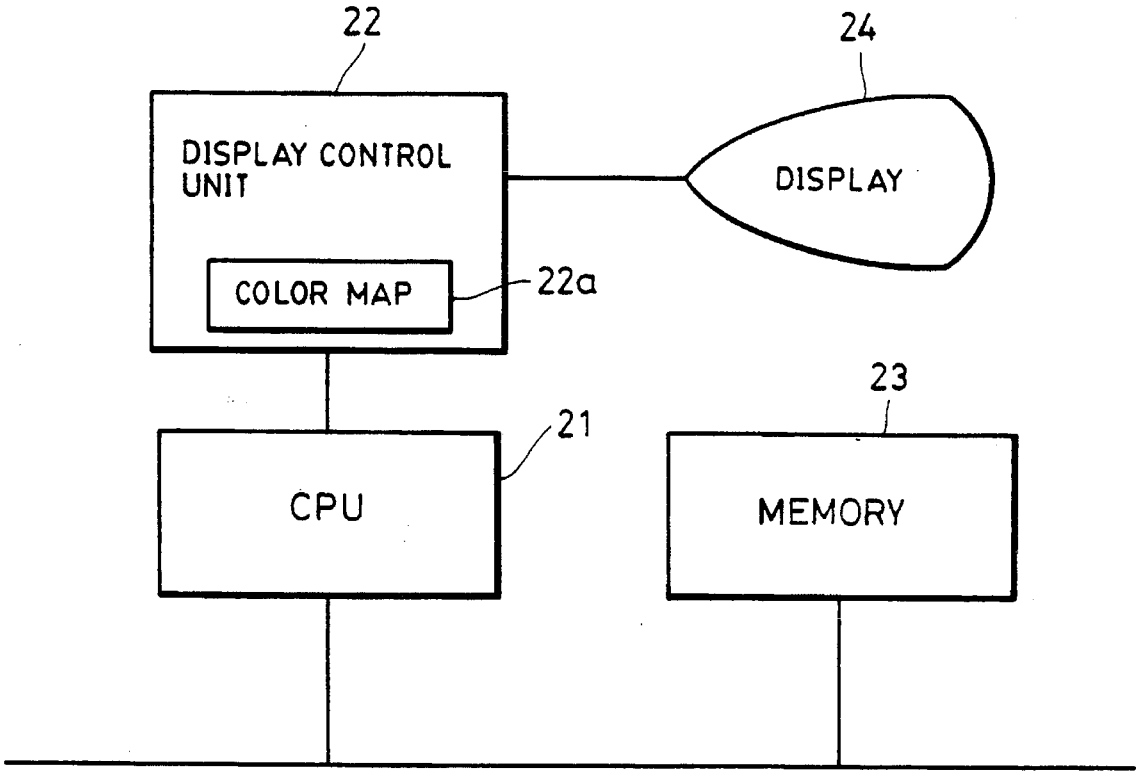
FIG. 2 is a diagram of the block construction of the embodiment of the present invention.

Referring to FIG. 1 which is a diagram of the process construction of the preferred embodiment of the present invention, a color map administration process 11 for managing the whole of a color map and display processes 12 and 13 are provided. Each process is conducted by a CPU 21 after a RAM section of a memory 23 described later with reference to FIG. 2 is loaded with data on the corresponding procedure written in a ROM section of the memory 23. Details of the operation of each process will be described later. The number of display processes is illustrated as two in this embodiment, but it is not limited to two.

Referring to FIG. 2 which is a diagram of the block construction of the embodiment of the present invention, the image processor has the CPU 21 for effecting overall control of the processor, and a display control unit 22 for controlling the display operation of a display 24 described later. The display control unit 22 has a color map 22*a* comprising a table such as that shown in FIG. 6 which has pixel values and corresponding values r, g, and b. The image processor also has the memory 23 for storing various categories of data. The memory 23 has the ROM section for storing programs corresponding to the flow charts of FIGS. 3 and 4, programs corresponding to various applications and the procedure of each process, and the RAM section for temporarily storing information required during processing. The processor further has the display 24 for displaying images.

The color map administration process 11 is conducted to control color cell data which is to be set in the color map (look-up table) 22*a* provided in the display control section 21. Colors of an image displayed on the display 24 can be changed by selecting color cell values set in the color map 22*a*. In this embodiment, the number of entries in the color map 22*a* is set to 256 (colors) although it need not be limited to 256. The way of setting the color map 22*a* is determined by color modes, described below.

Figure 5:
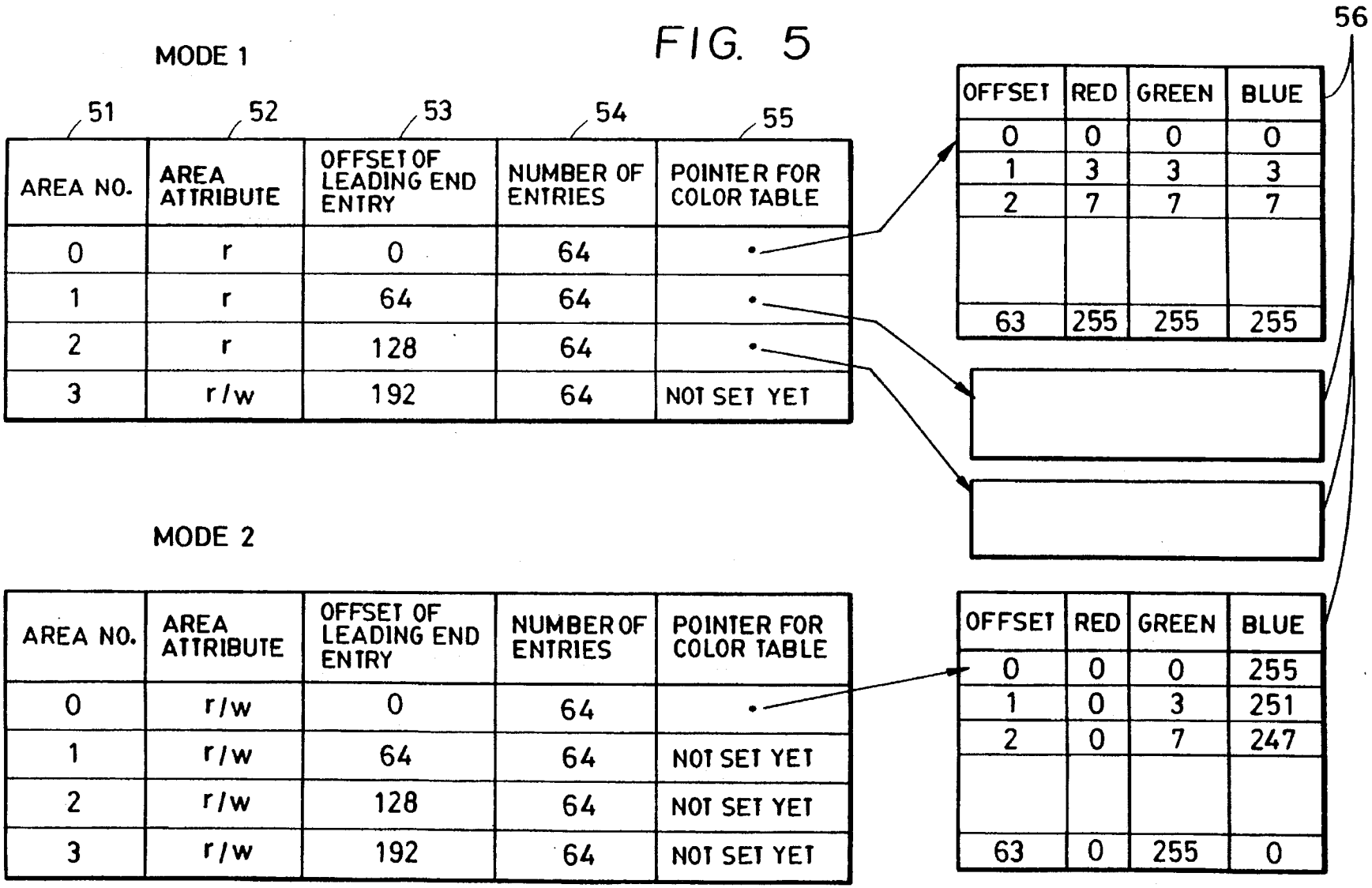
FIG. 5 is a diagram of an example of the color map administration process.

A color mode is a mode relating to the way in which the color map is divided. In this embodiment, there are two modes: mode 1 and mode 2, as shown in FIG. 5. In each mode, the color map, having 256 entries, is divided into four areas each having 64 entries, and area numbers 0, 1, 2, and 3 are attached to the divided areas.

In each mode, the color map is managed by the administration process 11 as an administration table such as the one formed as shown in FIG. 5. The administration table has area numbers 51, area attributes 52, offsets 53, the numbers of area entries 54, and pointers 55 pointing to color data tables 56.

There are four area numbers 51, i.e., 0 to 3, as mentioned above. There are two types of area attributes 52: writable (r/w) and non-writable (r). If the area attribute is r/w, color data is individually sent from the display process 12 or 13 to the color map administration process 11 to form and set a color data table 56. If the area attribute is r, a color data table 56 is formed and set by the color map administration process 11, and the setting of the color data table cannot be changed by the display process. In this case, only the set color data table is used.

In mode 1 of FIG. 5, the areas 0, 1, and 2 have attributes r. For these areas, three types of color maps frequently used are set. Also, the area attribute is r/w in the area 3 alone, and color data is set in this area if it is desirable to use a color map different from the set color maps.

In mode 2, the area attribute of each of the areas 0, 1, 2, and 3 is r/w, and all the desired data items are set on the display process side.

Next, the operation of the processes in accordance with this embodiment will be described with reference to FIGS. 3 and 4.

Figure 3:
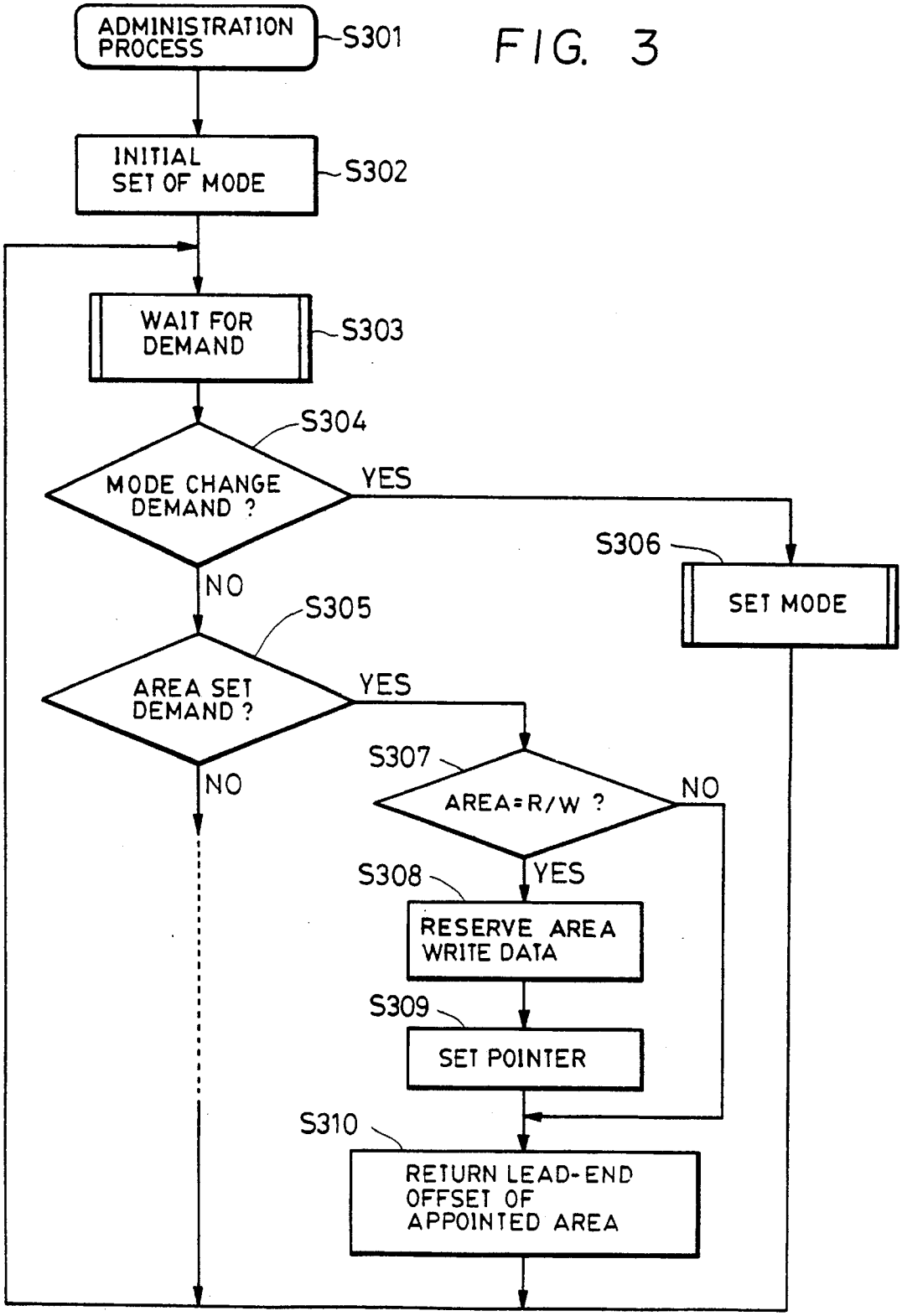
FIG. 3 is a flow chart of a color map administration process.

FIG. 3 is a flow chart showing the procedure of setting display areas based on the color map administration process 11.

The color map administration process is started in step S301, and the color mode is initially set in step S302. It is assumed here that the color mode is set to mode 1. In step S303, a demand from the display process is awaited. If the demand is a mode change demand, the mode is reset in step S306 and the process thereafter returns to step S303. The mode resetting is performed by setting the set values of the color map administration table in the color map 22*a*. If it is determined in step S303 that the demand from the display process is an area setting demand, the process proceeds to step S307 based on the determination of steps S304 and S305, to determine whether the attribute of the area is r/w or r from the designated area number and the present mode. In the case of r, a leading-end offset 53 of the area is returned in step S310, and the process returns to step S303. In the case of r/w, a color data table area 56 is allocated in step S308 to substitute color data from the display process 12 or 13 in this area, and a pointer 55 pointing to the allocated area is set in step S309. Thereafter, an offset 53 is provided in step S310, and the process returns to step S303.

In the case of a demand different from that in the above, suitable processing is conducted and the process returns to step S303.

Figure 4:
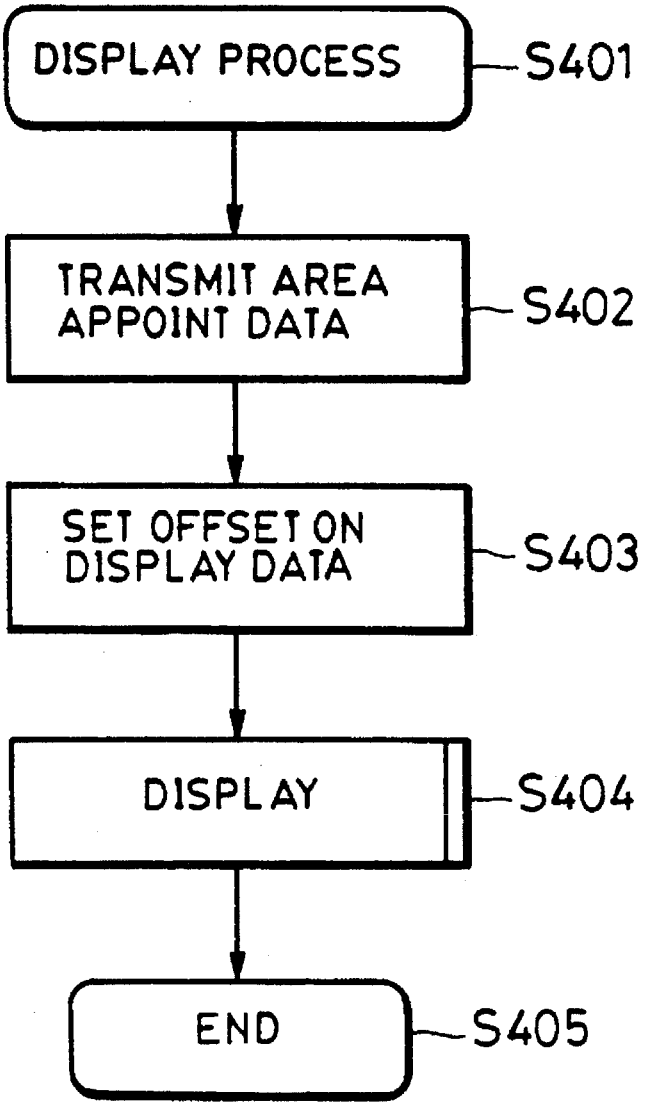
FIG. 4 is a flow chart of an image display process.

FIG. 4 is a flow chart for an image display which is effected after specific color map data has been assigned to each r/w area of the color map administration table. In step S402 of FIG. 4, an area number 51 and color map data are sent to the color map administration process 11 and the return of the offset corresponding to the area number is awaited. When the offset is returned, it is added to the image display data in step S403 and the result of this step is displayed in step S404. Display with the color map set by the color map administration process is thus executed.

In a case where an area such as area 0, 1, or 2 having attribute r in mode 1 is used, there is no need for sending color map data.

It is assumed here that a process assigned to area 3 in mode 1 is represented by A and that regions 0, 1, and 2 having attribute r are used for different processes B, C, and D. A process started subsequently holds the color map in common with one of the processes B, C, and D if it uses one of the known color maps of attribute r. It holds the same color map as the process A by designating the area number 3 if it uses the same color map as the process A, for example.

As described above in detail, it is possible to hold a color map in common between all the image display processes with respect to areas having area attribute r as well as to freely set a color map with respect to areas having area attribute r/w. If the set color map is known and if it is desirable to utilize this map, this color map can also be held in common in display processes other than the display process in which it is set.

In this embodiment, only color modes 1 and 2 are provided. However, it is possible to make other various modes by, for example, setting the number of divided entries to 32 or 128 instead of 64, changing the entry size of the respective areas, or changing the setting of area attributes. It is therefore possible to prepare modes according to the object to increase the number of image display applications which can hold a color map in common and, hence, to enable more images to be displayed simultaneously.

Further, if a certain category of information attached to the color map, e.g., data scaling information for display, is also managed by the color map administration process, a plurality of applications can hold the color map in common more effectively.

As described above, a means for dividing a color map to enable use of a plurality of applications and for collectively managing the divided color maps is provided. It is thereby possible to effectively manage a color map in common between a plurality of image display applications and, hence, to easily display a multiplicity of color images simultaneously.

The circuit elements shown schematically as blocks in the accompanying drawings, and the procedure set out there, are ones which either are commercially available, or can be easily implemented by those of ordinary skill.

Also, while the invention has been illustrated in detail by description of the preferred embodiment thereof, it is to be understood that the scope of the invention is not limited to the disclosed details, but is defined solely by the terms of the appended claims, which are to be interpreted broadly to incorporate equivalents of what is disclosed in this specification.

What is claimed is:

1. A method of displaying a plurality of color images simultaneously, including a color map administration process and a plurality of display processes each for displaying respective color images, simultaneously, said color map administration process comprising the steps of:

receiving a write request with color map data and an area identifier issued from one of said plurality of display processes for writing color map data in one of a plurality of memory areas, securing a memory area from the plurality of memory areas and writing the color map data in the secured memory area;

setting a pointer to the secured memory area associated with the area identifier in an administration table; and obtaining an offset corresponding to the color map data in the secured memory area from the administration table and transmitting the offset to the one of said display processes issuing the write request, and each one of said display processes comprising the steps of:

issuing a write request with color map data and an area identifier to said color map administration process for writing the color map data in one of a plurality of memory areas;

receiving an offset corresponding to the color map data written in the secured memory area from said color map administration process; and displaying a color image by using the color map data in the secured memory area on the basis of the received offset.

2. A method according to claim 1, wherein said color map administration process further comprises the steps of:

receiving a read request with an area identifier issued from one of said plurality of display processes for reading color map data in one of the plurality of memory areas corresponding to the area identifier;

obtaining an offset for the color map data in the memory area corresponding to the area identifier from the administration table and transmitting the offset to the one of said display processes issuing the read request, and wherein each one of said display processes further comprises the steps of:

issuing a read request with the color map data and an area identifier to said color map administration process for writing color map data in one of a plurality of memory areas;

receiving an offset for the color map data in the memory area corresponding to the area identifier from said color map administration process; and displaying a color image by using the color map data in the memory area corresponding to the area identifier on the basis of the received offset.

3. A method according to claim 2, wherein an area attribute to specify whether or not each of the memory areas is writable is set in the administration table.

4. A method according to claim 3, wherein said step of receiving the read request comprises the steps of, determining an area attribute corresponding to the area identifier received with a request, and treating the request as the read request if the area attribute is determined not to be writable.

5. A method according to claim 3, wherein color map data is stored in the memory area that the area attribute specifies not to be writable and a pointer to the memory area is set in the administration table in advance of receiving any request in said color map administration process.

6. A method according to claim 3, wherein said color map administration process further comprises the step of selecting the administration table from among a plurality of administration tables in which respective area attributes are specified.

7. A method according to claim wherein the area identifier is an area number.

* * * * *

UNITED STATES PATENT AND TRADEMARK OFFICE

CERTIFICATE OF CORRECTION

PATENT NO. : 5,570,115

DATED : October 29, 1996

INVENTORS : TOMOAKI KAWAI, ET AL.

It is certified that error appears in the above-identified patent and that said Letters Patent is hereby corrected as shown below:

COLUMN 1

Line 7, "08/" should read --07/--.

COLUMN 2

Line 41, "use" should read --used--.

COLUMN 5

Line 40, "procedure" should read --procedures--.

COLUMN 6

Line 46, "of," should read --of--;
Line 60, "claim" should read --claim 1--.

Signed and Sealed this

Fourth Day of March, 1997

*Attest:*

*Attesting Officer*

BRUCE LEHMAN

*Commissioner of Patents and Trademarks*